United States Patent [19]

Paul

[11] 4,366,784

[45] Jan. 4, 1983

[54] CRANKLESS CAM DRIVEN PISTON ENGINE

[76] Inventor: Brayton B. Paul, 1134 Wonder La., NE., Marietta, Ga. 30062

[21] Appl. No.: 244,245

[22] Filed: Mar. 16, 1981

[51] Int. Cl.[3] ..... F02B 53/00

[52] U.S. Cl. ..... 123/45 A; 123/47 A; 123/58 A; 123/DIG. 3

[58] Field of Search ..... 123/DIG. 3, 45 R, 45 A, 123/58 R, 58 A, 47 R, 47 A

[56] References Cited

U.S. PATENT DOCUMENTS 2,489,150 11/1949 McCoy ..... 123/DIG. 3

4,090,478 5/1978 Trimble et al. ..... 123/58 R

FOREIGN PATENT DOCUMENTS 1915109 10/1970 Fed. Rep. of Germany ... 123/45 A

*Primary Examiner*—Craig R. Feinberg

*Attorney, Agent, or Firm*—Newton, Hopkins & Ormsby

[57] ABSTRACT

A lightweight crankless piston engine utilizes cam action to produce two piston strokes for one revolution of the engine output shaft, which shaft does not pierce the piston or the combustion chamber. Ease of assembly is enabled. One section of the cam is embodied in the cylinder liner and the opposing cam section is an extension of the output shaft housing. In its simplest mode, the engine is ported for fuel-air induction and exhaust. Cam induced piston rotation directly drives the output shaft while piston reciprocation is allowed without influencing such shaft.

8 Claims, 10 Drawing Figures

CRANKLESS CAM DRIVEN PISTON ENGINE

BACKGROUND OF THE INVENTION

Crankless engines of the cam-activated piston type are known in the patented art. Examples of such known engines are shown in U.S. Pat. Nos. 3,189,453 and 3,994,632, as well as others. A common drawback in prior engines of this type is the difficult task of effectively sealing the rotary output shaft which usually pierces the piston, combustion chamber end wall, or both. This drawback has been entirely eliminated in the present invention in accordance with one of its main objectives.

The invention also provides an engine of minimized weight and a high degree of compactness along with ease of assembly. The engine can be embodied in single or multiple cylinder designs. In the disclosed embodiment for a single cylinder ported engine, the activating cam which produces piston rotation to drive the engine output shaft enables two piston reciprocations for each revolution of the output shaft, thus simulating a two cylinder engine.

Various lost motion connections between the piston and output shaft can be utilized to allow piston reciprocation induced by ignition while cancelling the effect of this reciprocation on the rotary output shaft.

Other features and advantages of the invention will become apparent during the course of the following detailed description.

DETAILED DESCRIPTION

Figure 1:
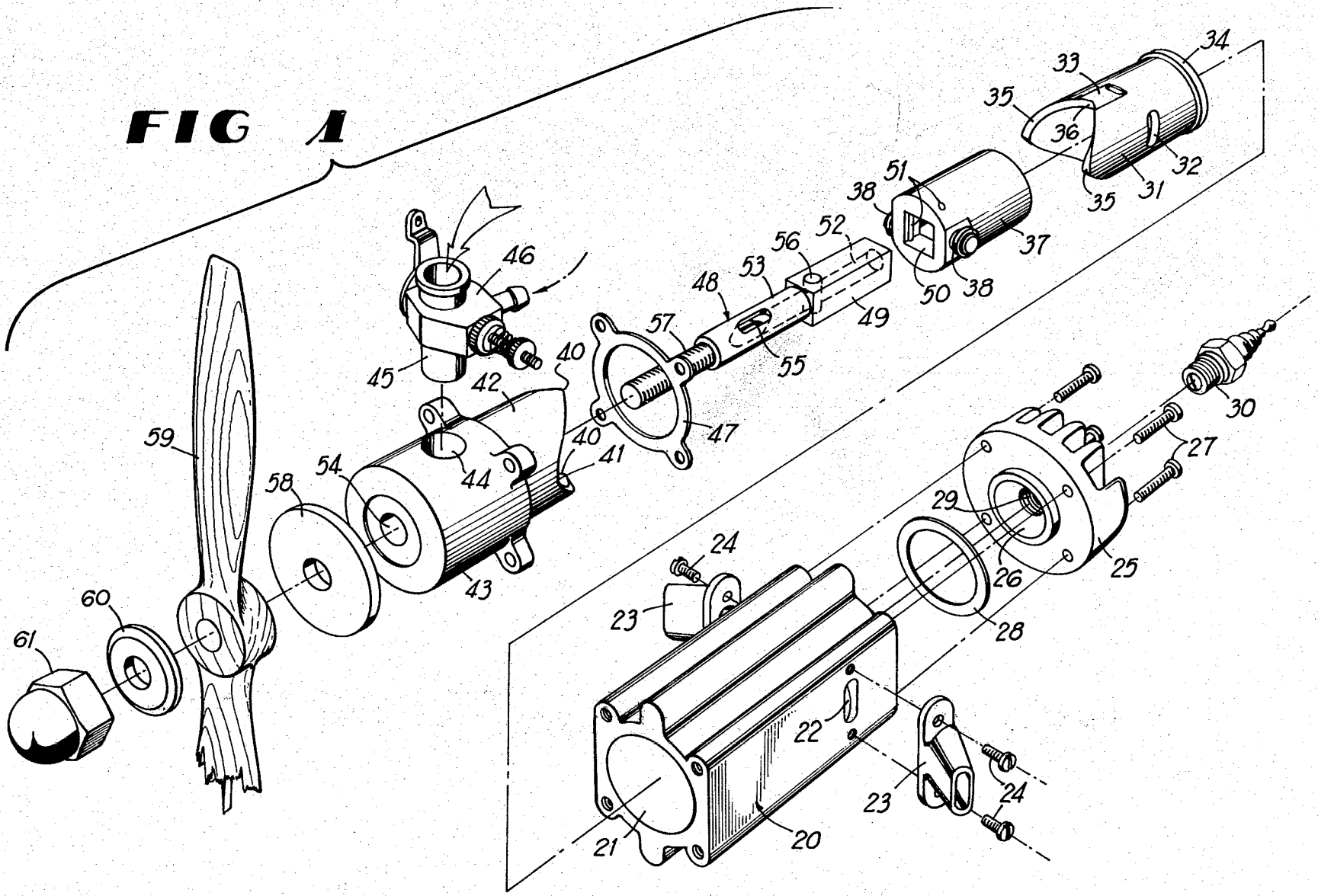
FIG. 1 is an exploded perspective view of a crankless piston engine in accordance with the invention.
Figure 2:
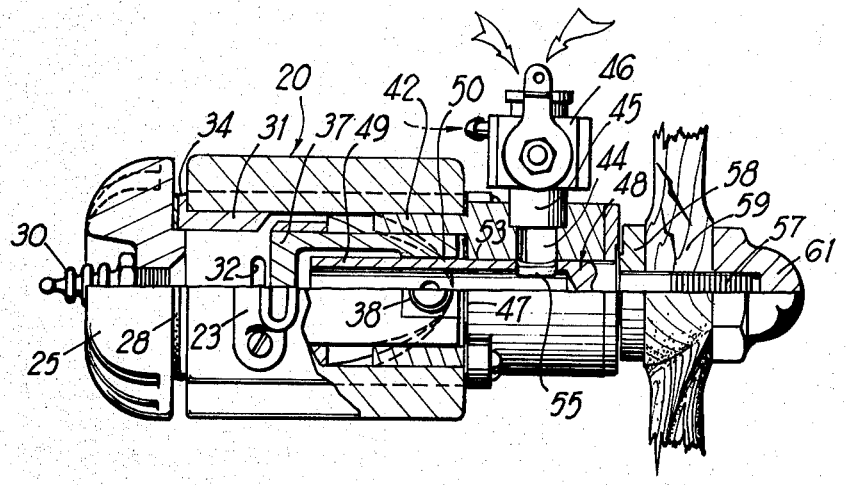
FIG. 2 is a side elevation of the assembled engine, partly in vertical cross section, and with the piston at the bottom of its stroke.
Figure 3:
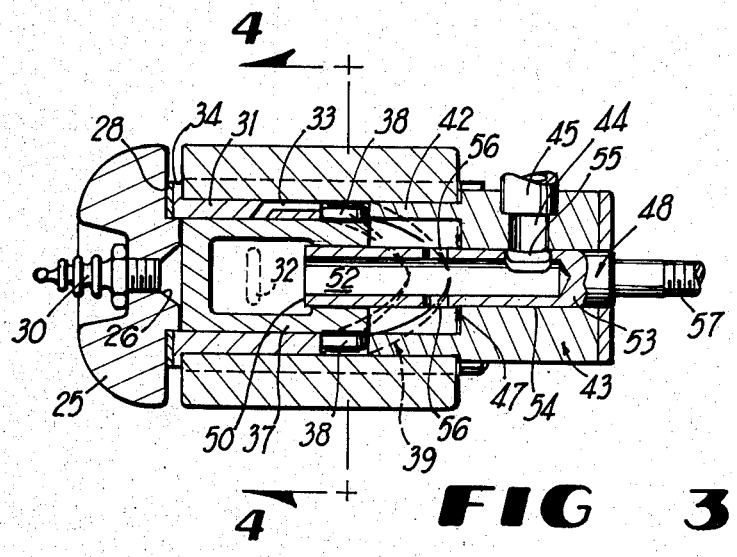
FIG. 3 is a similar view of the engine with the piston at the top of its stroke.
Figure 4:
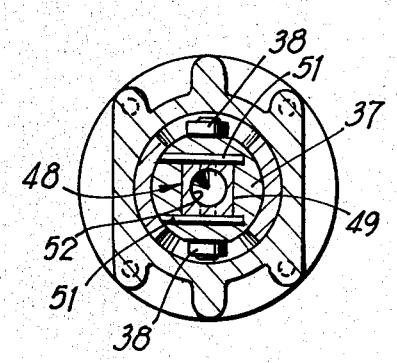
FIG. 4 is a transverse vertical section taken on line 4—4 of FIG. 3.

Referring to the drawings in detail wherein like numerals designate like parts, a crankless cam-actuated one cylinder engine embodying the invention comprises a cylinder block 20 having a through bore 21 and side exhaust ports 22 leading from the through bore near one end of the block. Exhaust stacks 23 on opposite sides of the block 20 are secured by screws 24 in communication with the exhaust ports 22.

A cylinder head 25 having a central combustion chamber 26 is coupled by screws 27 to one end of the block 20, with a head gasket 28 intervening, as shown. A central threaded opening 29 in the head 25 communicating with combustion chamber 26 receives a spark plug 30 in coaxial relationship with the through bore 21.

A cylinder liner 31 having an exhaust port 32 in registration with the port 22 and having a bypass port 33 is removably fixed in one end of the cylinder block through bore 21 with an end flange 34 of the liner in abutment with the head gasket 28 and disposed therewith between the end faces of the block 20 and head 25.

Figure 5:
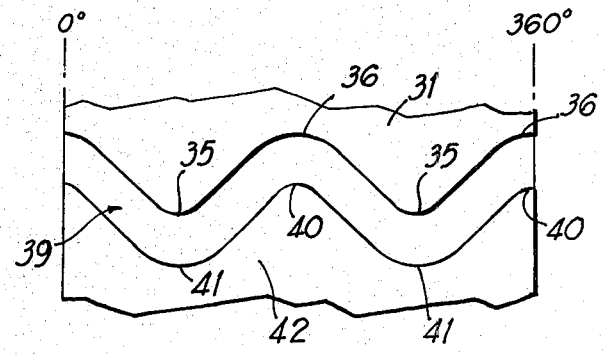
FIG. 5 is a roll out schematic view of a cam slot between two axially opposing cam elements.

Two diametrically opposed roughly sinusoidal cam lobes 35 and intervening valleys 36 are formed on the liner 31, and a rolled out 360 degree schematic of the cam profile is shown in FIG. 5 for clarity.

A piston 37 mounted for reciprocation and rotation in the bore of liner 31 has cam follower rollers 38 on diametrically opposite sides for engagement within a cam track 39, FIG. 5, formed by the cam lobes and valleys 35 and 36 and the opposing lobes and valleys 40 and 41 on a cylindrical cam extension 42 of a shaft housing 43.

The cam extension 42 enters the other end of cylinder block through bore 21 and is fixed therein in axially spaced relationship to the liner 31 to define the roughly sinusoidal cam slot 39. When the parts are assembled, the components 31 and 42 remain fixed relative to the block 20 with the follower rollers 38 trapped movably in the cam slot 39 between the components 31 and 42 and able to move relative thereto when an engine explosion occurs, as will be further described.

The shaft housing 43 has a side induction passage 44 which receives the barrel 45 of a conventional carburetor 46 capable of delivering to the engine a proper air-fuel mixture. A housing gasket 47 is placed between the other end face of the block 20 and the opposing end face of shaft housing 43 to seal the assembly.

An important element of the invention consists of an axial output shaft 48 for the engine having a square head 49 slidable within a square opening 50 of piston 37. The opening 50 preferably has teflon or other anti-friction elements 51 on opposite sides thereof to minimize sliding friction with the square head 49. The head 49 has an axial bore 52 formed therein and extending into an intermediate cylindrical section 53 of the shaft 48 and terminating therein. The portion or section 53 of the shaft is received in a bore 54 of housing 43 rotatably. The shaft section 53 has an intake port 55 or slot formed therein adapted to communicate with the passage 44 of housing 43 and leading to the central bore 52 of the shaft. The square head 49 also has diametrically opposed ports 56 leading from the central bore 52, whose purpose will be further described.

The engine shaft 48 has a forward threaded extension 57 projecting forwardly of the housing 43 and receiving thereon a drive washer 58, a propeller hub 59, propeller washer 60 and nut 61 in stacked assembled relationship.

It may now be noted that all of the engine components, when assembled, are in compact coaxial relationship. The shaft 48 does not pierce either the combustion chamber 26 or the head of piston 37. As a consequence, costly and difficult sealing problems are avoided in contrast to the prior art. Also the number of engine parts is minimized and weight is also minimized. The engine lends itself to easy assembly.

The operation of the crankless engine can be summarized as follows, with particular reference to drawing FIGS. 6 and 7. When the piston 37 moves to the left in the figures, the air-fuel charge is inducted while the shaft slot 55 is in registration with the induction passage 44 leading from the carburetor, FIG. 6. Induction is caused by the partial vacuum existing in the chamber behind the piston 37, at the same time that the combustion space ahead of the piston is being reduced in size thereby compressing the fuel change preparatory to ignition.

Figure 6:
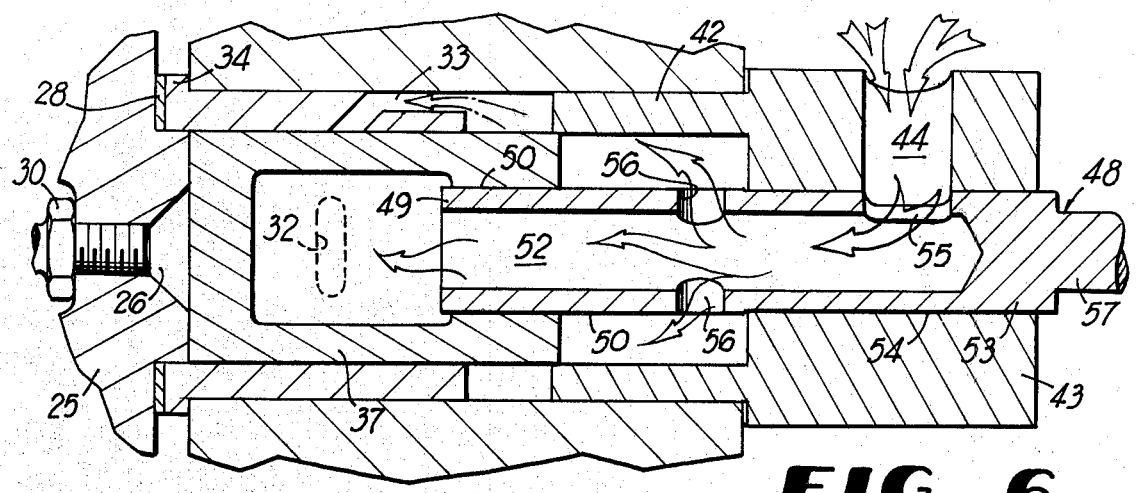
FIG. 6 is an enlarged central vertical section through the engine with the piston at the top of its stroke covering exhaust ports and showing the inflow path of inducted fuel.
Figure 7:
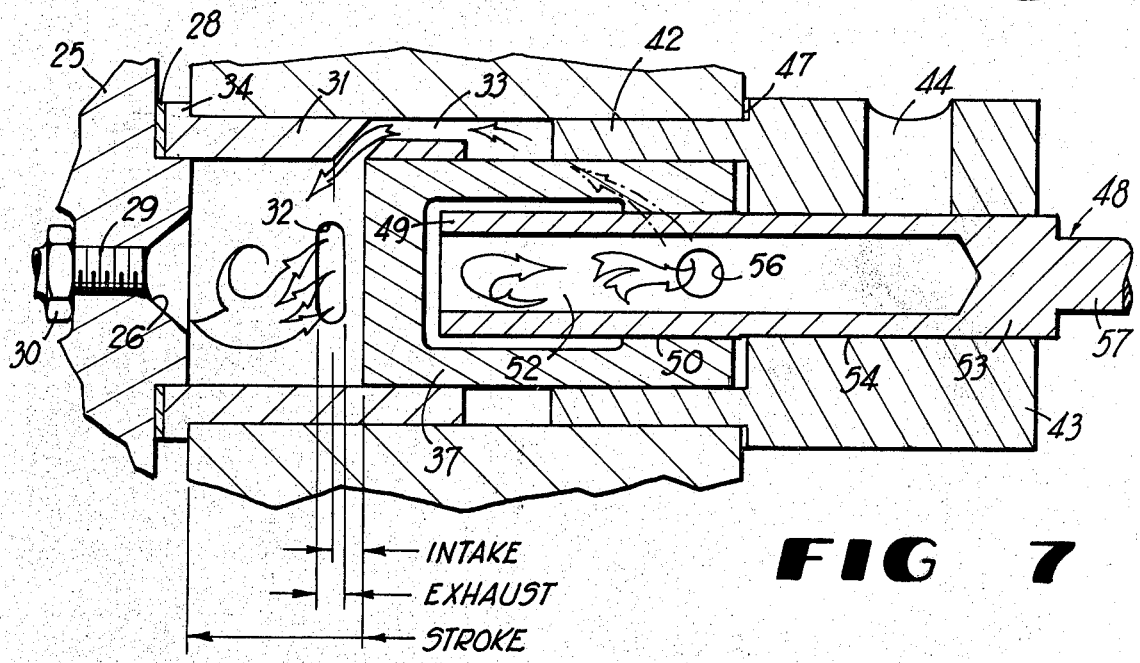
FIG. 7 is a similar view showing the piston at the bottom of its stroke uncovering the exhaust ports and depicting the exhaust outflow path and the inflow path of a fresh fuel charge.

When the piston 37 reaches its topmost position, FIG. 6, the charge is ignited by spark plug 30, instantly increasing presure in the combustion chamber and driving the piston 37 to the right, FIGS. 6 and 7, causing shaft 48 to rotate for producing work. This rotation is achieved as a result of the piston cam follower rollers 38 following the cam track 39 which is relatively stationary. Because of the paired cam lobes 35 and 40 spaced 180 degrees apart, the piston 37 will reciprocate twice in response to two explosions of fuel for each full revolution of the shaft 48. Thus, the engine behaves like a two cylinder two cycle engine rather than a typical one cylinder engine.

By virtue of the two cam followers 38 on the piston 31 being positioned 180 degrees apart, the piston 31 is in static and dynamic balance as opposed to some prior art engines with only one cam follower which creates eccentric forces on the piston as it revolves and reciprocates. Another advantage advanced by this construction is that the forces of combustion driving the piston 31 through the path of the cam track 39 via the dual followers 38 is that the forces on the piston 31 are laterally equalized as opposed to a single follower as found in some prior art engines which create unequal forces at one point in the circumference of the piston and cylinder assembly.

This unbalanced effect is also found in conventional connecting rod pistons when it is cycling, in that the piston rod and piston are connected only at one point and when the piston reciprocates it is cantedly forced up or down against one wall of the cylinder causing objectionable side loads resulting in uneven piston and cylinder wear and increased friction.

Near the end of travel of the piston 37 to the right, FIG. 7, the bypass port 33 is uncovered as shown in FIG. 7 and exhaust port 32 in liner 31 is also uncovered. This allows exhaust gases to be vented from the combustion chamber, and simultaneously, a fresh air-fuel charge will enter the enlarged combustion chamber.

As the piston 37 moves to the right toward the bottom of its stroke, the resulting rotation of the shaft 48 has moved the intake port 55 out of registration with induction passage 44, so that the fresh fuel-charge is trapped behind the piston and becomes compressed, forcing it to move through the bypass passage 33 and into the combustion chamber as indicated by the directional arrows in FIG. 7.

While the piston 37 rotates to drive the shaft 48, it also reciprocates responsive to each explosion. However, the sliding engagement of the square head 49 in the square opening 50 of the piston allows this reciprocatory motion while nullifying its effect on the shaft, and only the rotational motion of the piston is transferred to the shaft. Other non-circular shapes for the head 49 and opening 50 can be utilized, and in lieu of such arrangement, a suitable pin and slot connection between the shaft and piston or other known forms of lost motion connections can be utilized.

Figure 8:
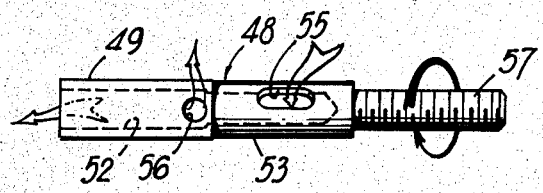
FIG. 8 is a side elevation of an engine output shaft rotating in a direction to operate a pusher prop.
Figure 9:
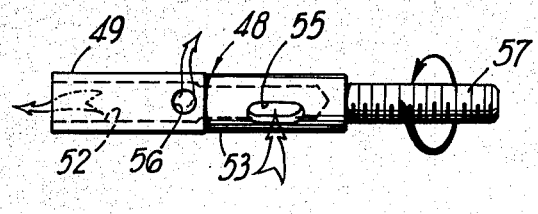
FIG. 9 is a similar view of the shaft counter-rotating as for operating a puller prop.

FIG. 8 depicts clockwise rotation of the shaft 48 for driving a pusher prop, while FIG. 9 depicts counterclockwise rotation for driving a puller prop. The engine can be utilized for other purposes and can have wide utility.

Figure 10:
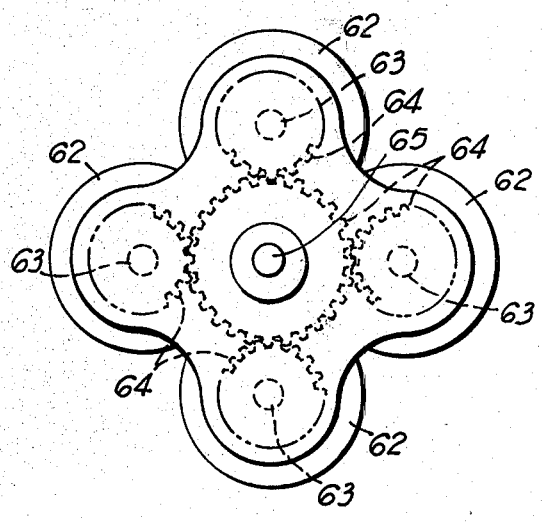
FIG. 10 is a partly schematic end elevation of an engine having four cylinders in parallel axis relationship in accordance with an alternate embodiment of the invention.

As shown in FIG. 10, in lieu of the single cylinder embodiment described, multiple parallel axis cylinders 62, such as four cylinders, can have their output shafts 63 connected through gearing 64 to a central driving shaft 65. Tandem arrangement of cylinders is also feasible where more power is required.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A crankless engine comprising a block and head unit having a bore opening through a surface of the block remote from said head, fixed liner means in said bore defining therein an approximately sinusoidal annular cam slot, a piston mounted within said liner and having follower means engaging said annualar cam slot for reciprocation and rotation responsive to the configuration of said cam slot, and engine output shaft projecting into the interior of the piston and being concentric to and rotationally keyed to the piston and being rotatably supported on the end of the block and head unit remote from said head, said liner means and said unit having exhaust passage means, said shaft having fuel induction passage means, and said liner having bypass induction means communicating with a combustion chamber of the engine when said piston is near the bottom of its stroke for uncovering said exhaust passage means and said piston and output shaft defining a chamber within the body of the piston whose volume is determined by the axial position of the piston, said block having a radial port remote from said head and said fuel induction passage means comprising an axial bore through said output shaft communicating with said chamber within the body of the piston and said axial bore further communicating with a radial passage aligning with said radial port in said block only when the piston is substantially in an axial position most proximate to said head wherein the volume of said chamber within the body of the piston is maximum during each cycle of the engine.

2. A crankless engine as defined in claim 1 and said bypass induction means comprising a bypass port in the side wall of said liner, and a second radial passage in the said axial bore of the output shaft, said second radial passage being in alignment with the bypass port of said liner when the piston is in an axial position most remote from the head and wherein the volume of the chamber within the piston is at this time of minimum volume.

3. A crankless engine comprising a block having a bore and exhaust passage means, means on one end of the block forming a combustion chamber therewith and including ignition means, a shaft housing on the other end of the block having a fuel induction passage adapted to deliver an air-fuel charge to the engine, a liner fixed in the bore of the block and having an exhaust port in registration with said exhaust passage means and also having a bypass port in its side wall, a cam extension on said liner within said bore of the block, a coacting cam extension on said shaft housing and extending into said bore in spaced relationship to the liner cam extension and forming therewith a cam track in said block, a piston mounted within said liner for simultaneous reciprocation and rotation responsive to an explosion of fuel in said combustion chamber, follower means on the piston engaging said cam track, and an engine output shaft rotatably engaged with said shaft housing and having a telescoping lost motion connection with said piston whereby rotation of the piston directly drives said shaft in rotation while the reciprocation of the piston is allowed without influencing said shaft, and said shaft having a bore and having an intake port communicating with the bore and adapted during rotation of the shaft to register cyclically with said fuel induction passage, said shaft having another port communicating with the shaft bore adapted to deliver a fuel charge through said bypass port and into the combustion chamber.

4. A crankless engine as defined in claim 3, and said cam track being approximately sinusoidal including two rises and two valleys around the bore of said block, whereby said piston reciprocates twice in response to two engine explosions for each complete revolution of said shaft.

5. A crankless engine as defined in claim 3, and said coacting cam extension being in the form of a sleeve having a bore which receives said piston when the piston is driven by explosion away from the first named means.

6. A crankless engine as defined in claim 3, and said cam extension on said liner having two diametrically spaced cam lobes and two intervening diametrically spaced valleys, and said coacting cam extension having two diametrically spaced cam lobes aligned with the valleys of the liner cam extension and two diametrically spaced valleys aligned with the lobes of the liner cam extension.

7. A crankless engine as defined in claim 3, and said means on one end of the block comprising a separable cylinder head carrying a spark plug in coaxial realtionship with said combustion chamber.

8. A crankless engine as defined in claim 3, and said telescoping lost motion connection comprising a polygonal cross section head on said shaft having sliding engagement within an opening of like cross sectional shape formed axially in said piston.

* * * * *